US005535533A

United States Patent [19]

Romanchok

[11] Patent Number: 5,535,533

[45] Date of Patent: Jul. 16, 1996

[54] LIFT ARMS AND LINKAGE ARRANGEMENT FOR A BUCKET

[75] Inventor: Kevin J. Romanchok, Raleigh, N.C.

[73] Assignee: Caterpillar Inc., Peoria, Ill.

[21] Appl. No.: 320,020

[22] Filed: Oct. 7, 1994

[51] Int. Cl.[6] ..... E02F 3/96

[52] U.S. Cl. ..... 37/403; 414/722; 414/686

[58] Field of Search ..... 172/810; 37/403, 37/404; 414/722, 635, 686

[56] References Cited

U.S. PATENT DOCUMENTS

| | | | |
|---|---|---|---|
| 2,468,602 | 4/1949 | Lord | 414/686 |
| 2,815,876 | 12/1957 | Rogers | 414/686 |
| 3,181,430 | 5/1965 | Freedy et al. | 414/685 |
| 5,273,375 | 12/1993 | Plourde | 37/403 |

FOREIGN PATENT DOCUMENTS

| | | | |
|---|---|---|---|
| 2622219 | 12/1972 | Germany | 414/722 |

OTHER PUBLICATIONS

Photos of tractor using linkage of claimed application. Taken Oct. 1995.

*Primary Examiner*—Spencer K. Warnick, IV
*Attorney, Agent, or Firm*—Claude F. White

[57] ABSTRACT

The lift arms and linkage arrangement for the bucket of a loading machine includes first and second spaced apart lift arm assemblies and first and second spaced apart linkage assemblies associated with respective lift arm assemblies. The first and second lift arm assemblies diverge with respect to the centerline of the machine while the first and second linkage assemblies are parallel to the centerline of the machine. The first and second lift arm assemblies are closer to each other at the machine end than at the bucket end. This provides greater visibility of the corners of the bucket for the machine operator and more precise positioning of the bucket by the operator.

20 Claims, 5 Drawing Sheets

LIFT ARMS AND LINKAGE ARRANGEMENT FOR A BUCKET

TECHNICAL FIELD

This invention relates generally to a lift arm and linkage arrangement for a work implement of a work machine, such as a bucket, and more particularly to an arrangement which provides increased visibility of portions of the work implement to the machine operator.

BACKGROUND ART

Work machines, such as backhoe loader, track loaders, and wheel loaders have a material handling bucket connected to one end of the machine for performing various work functions. The functions include loading material from stockpiles into trucks, digging material and transporting it to a dump site, and cleaning and hauling loose material from a construction or building site. Smaller type work machines, such as backhoe loaders are very versatile and are used frequently by small size contractors and independent owners to perform many different types of work functions. These machines are often operated close to existing buildings and/or new construction and require good skills by the operator to prevent damage to nearby structures. When the work bucket is being used to clean up or load material adjacent structures, it is difficult for the operator to see the outside edges or corners of the bucket. This is due to the location and arrangement of the arms and linkages which connect the bucket to the machine and which manipulate the bucket. These arms and linkages often block the operator's view of the bucket's outside edges and corners.

The present invention is directed to overcoming one or more of the problems as set forth above.

DISCLOSURE OF THE INVENTION

In one aspect of the present invention, an arrangement of lift arms and linkages for lifting and manipulating a work implement of a work machine includes first and second spaced apart lift arm assemblies and first and second linkage assemblies associated with respective lift arm assemblies. The machine has a centerline and the linkage assemblies are substantially parallel to the centerline. Each of the lift arms has a first end portion adapted to be connected to a work machine and a second end portion adapted to be connected to a work implement. The first and second arm assemblies are substantially non-parallel to the machine centerline.

Because small work machines, such as backhoe loaders and wheel loaders, are versatile and easily manipulated, they are widely utilized in small construction sites and work sites which are crowded and close to existing buildings or new construction. To prevent damage to existing structures, the operators require great skill when loading and manipulating the bucket. Good visibility of the bucket corners and edges helps the machine operator to do close work and avoid any contact of the bucket with existing structures.

The subject arrangement of lift arms and linkages offer a solution to the problem of the machine operator being able to view the bucket corners by having the lift arms narrow near the machine and widen near the bucket.

BEST MODE FOR CARRYING OUT THE INVENTION

Figure 1:
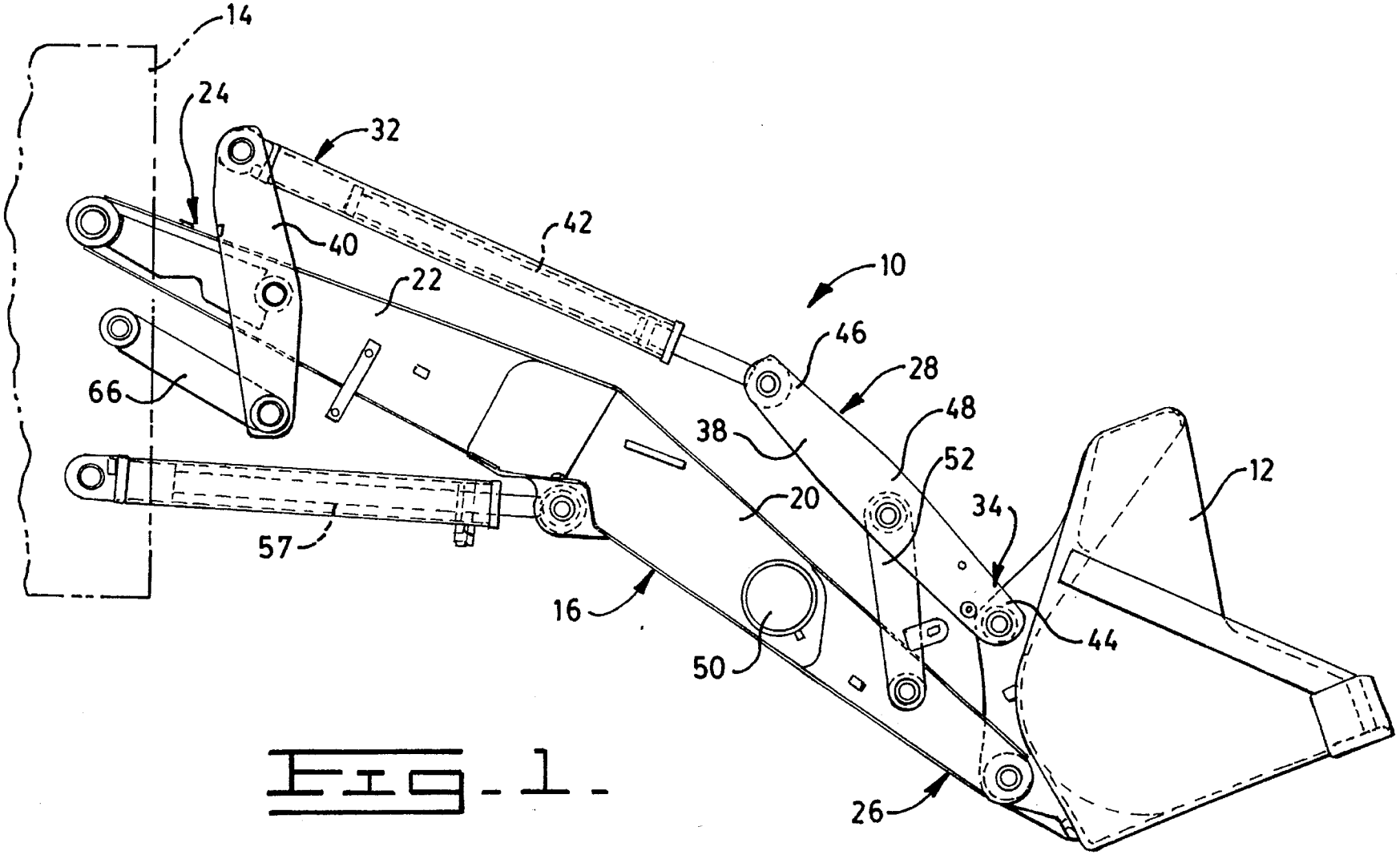
FIG. 1 is a diagrammatic side elevational view of the subject lift arms and linkage arrangement connected between a work machine and a work implement.
Figure 2:
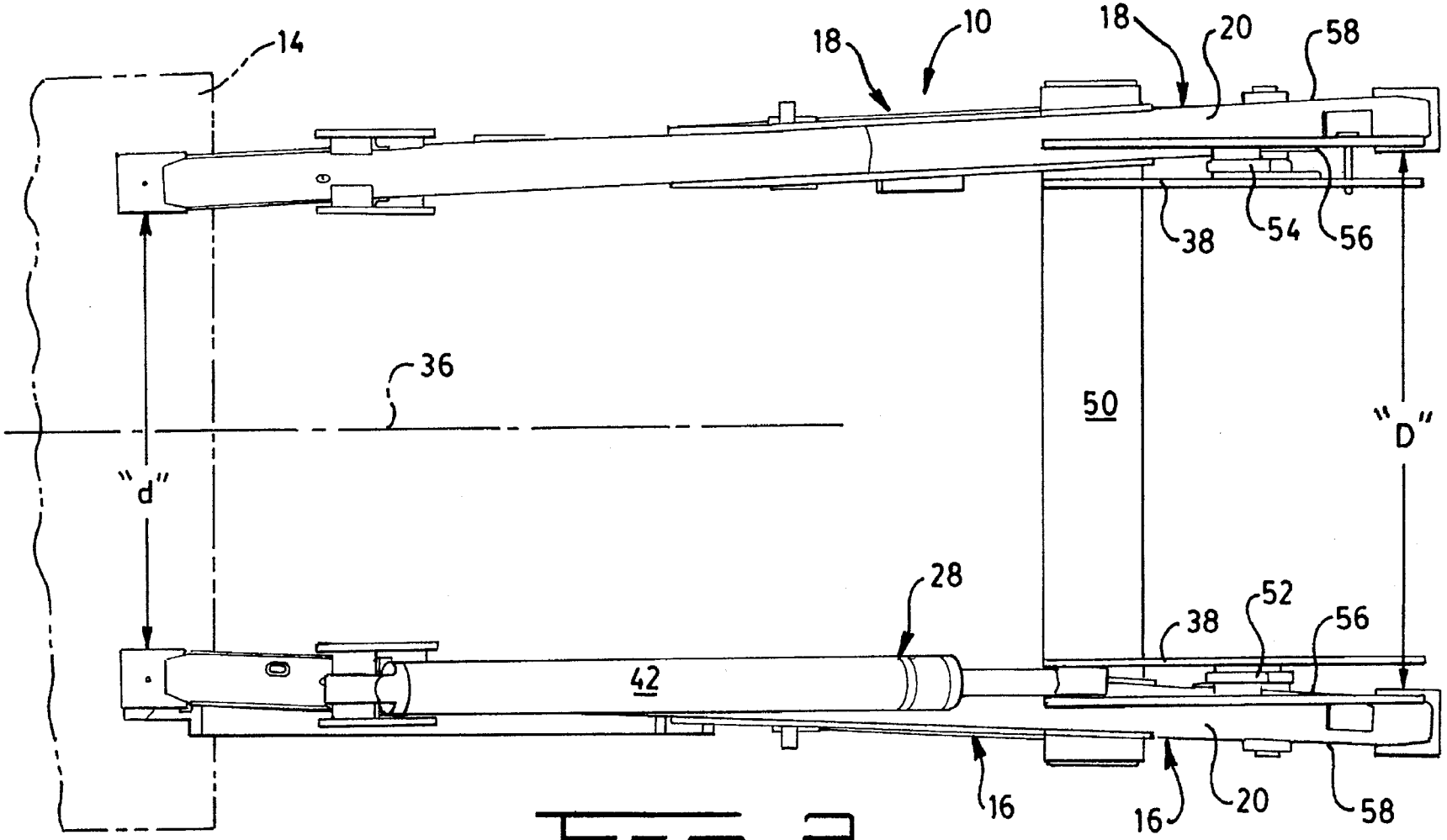
FIG. 2 is a diagrammatic top plan view of the subject lift arms and linkage arrangement with the work implement shown in phantom lines.
Figure 3:
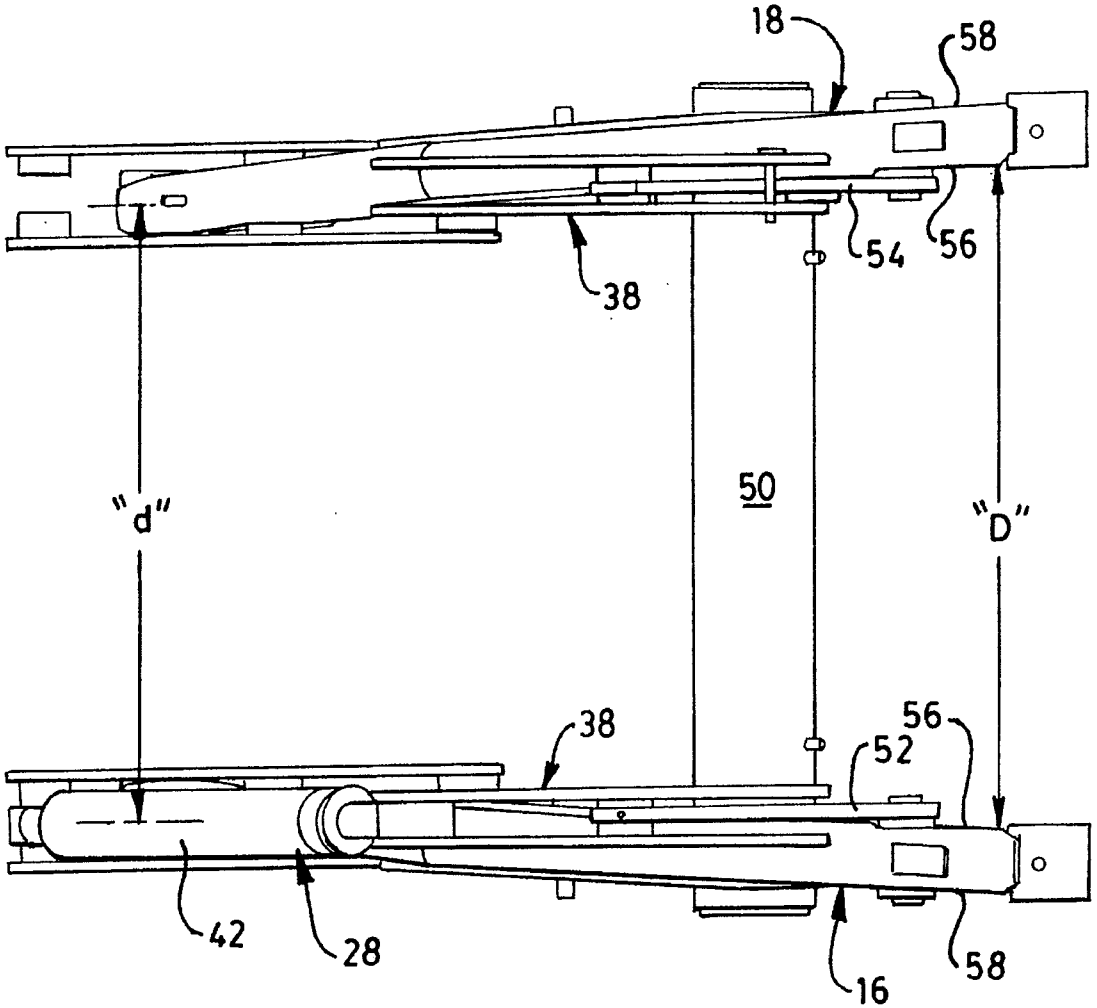
FIG. 3 is a diagrammatic front elevational view of the subject lift arms and linkage arrangement.

With reference to the drawings, an arrangement 10 of lift arms and linkage for manipulating a work implement 12, such as a bucket 12, of a work machine 14 includes first and second spaced apart lift arm assemblies 16,18, each having a front beam portion 20 and a rear beam portion 22. Each lift arm assembly 16,18 has a first end portion 24 which is adapted to be connected to the work machine 14, and a second end portion 26 which is adapted to be connected to the bucket 12. The arrangement 10 further includes first and second spaced apart linkage assemblies 28,30 which are associated with the respective lift arm assembly 16,18. Each of the linkage assemblies 28,30 has a first end portion 32, which is connected to the first end portion 24 of a respective lift arm assembly 16,18, and a second end portion 34, which is adapted to be connected to the bucket 12. The work machine 14 has a centerline 36, and the linkage assemblies 28,30 are substantially parallel to the centerline 36, while the lift arm assemblies 16,18 are substantially non-parallel to the centerline 36.

The first and second lift arm assemblies 16,18 actually diverge with respect to the centerline 36. The first end portions 24 of the lift arm assemblies 16,18 are spaced one from the other a predetermined first distance (d), and the second end portions 26 of the lift arm assemblies 16,18 are spaced one from the other a predetermined second distance (D). The first distance (d) is substantially smaller than the second distance (D). In actual dimensions, the second distance (D) is at least 15 percent greater than the first distance (d).

Each of the linkage assemblies 28,30 includes first and second bifurcated brackets 38,40 and a fluid cylinder 42. The first bracket 38 is adapted to be connected to the bucket 12 and the second bracket 40 is connected to the rear beam portion 22 of the lift arm assemblies 16,18. The fluid cylinder 42 is connected between the first and second brackets 38,40. Each of the first bifurcated brackets 38 has first and second end portions 44,46 and a middle portion 48. The first end portion 44 is adapted to be connected to the bucket 12 and the second end portion 46 connects to the fluid cylinder 42. A cross-beam 50 connects the first lift arm assembly 16 to the second lift arm assembly 18.

A first single guide link 52 connects the first lift arm assembly 16 to the first linkage assembly 28, and a second single guide link 54 connects the second lift arm assembly 18 to the second linkage assembly 30. The first and second guide links 52,54 are positioned adjacent to and are connected to the second end portions 26,34 of the lift arm assemblies 16,18 and the linkage assemblies 28,30. The guide links 52,54 are more specifically connected between the middle portions 48 of the first bifurcated brackets 38 and the respective first and second lift arm assemblies 16,18.

Each of the front beam portions 20 of each lift arm assembly 16,18 has inner and outer side portions 56,58 and the first and second guide links 52,54 are connected to the respective inner side portions 56. The guide plates 52,54 of each linkage assembly 28,30 are therefore substantially centered with the respective linkage assembly 28,30 and are offset with the respective lift arm assemblies 16,18.

First and second fluid lift cylinders 57,59 are connected between the work machine 14 and the respective first and second lift arm assemblies 16,18. The second bifurcated brackets 40 each have first and second end portions 60,62 and a middle portion 64. The fluid cylinders 42 connect to the second end portions 62 of each second bracket 40 and the middle portions 64 connect to the rear beam portions 22 of the lift arm assemblies 16,18. First and second connecting links 66,68 connect the first end portions 60 of the second brackets 40 to the work machine 14. This, in effect, connects the first and second linkage assemblies 28,30 directly to the machine 14.

Figure 4:
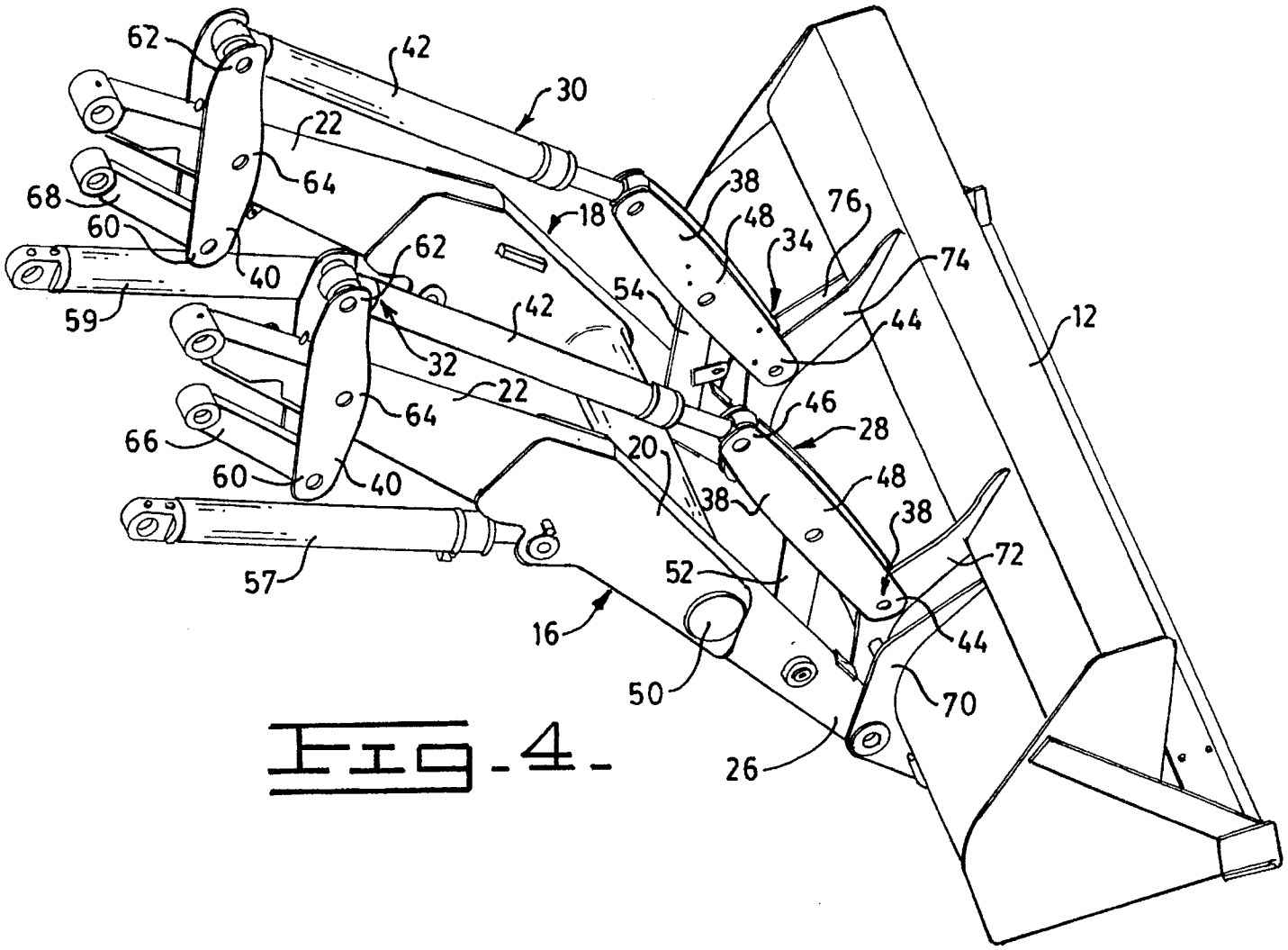
FIG. 4 is a diagrammatic perspective view of the subject lift arms and linkage arrangement with a work implement connected thereto.
Figure 5:
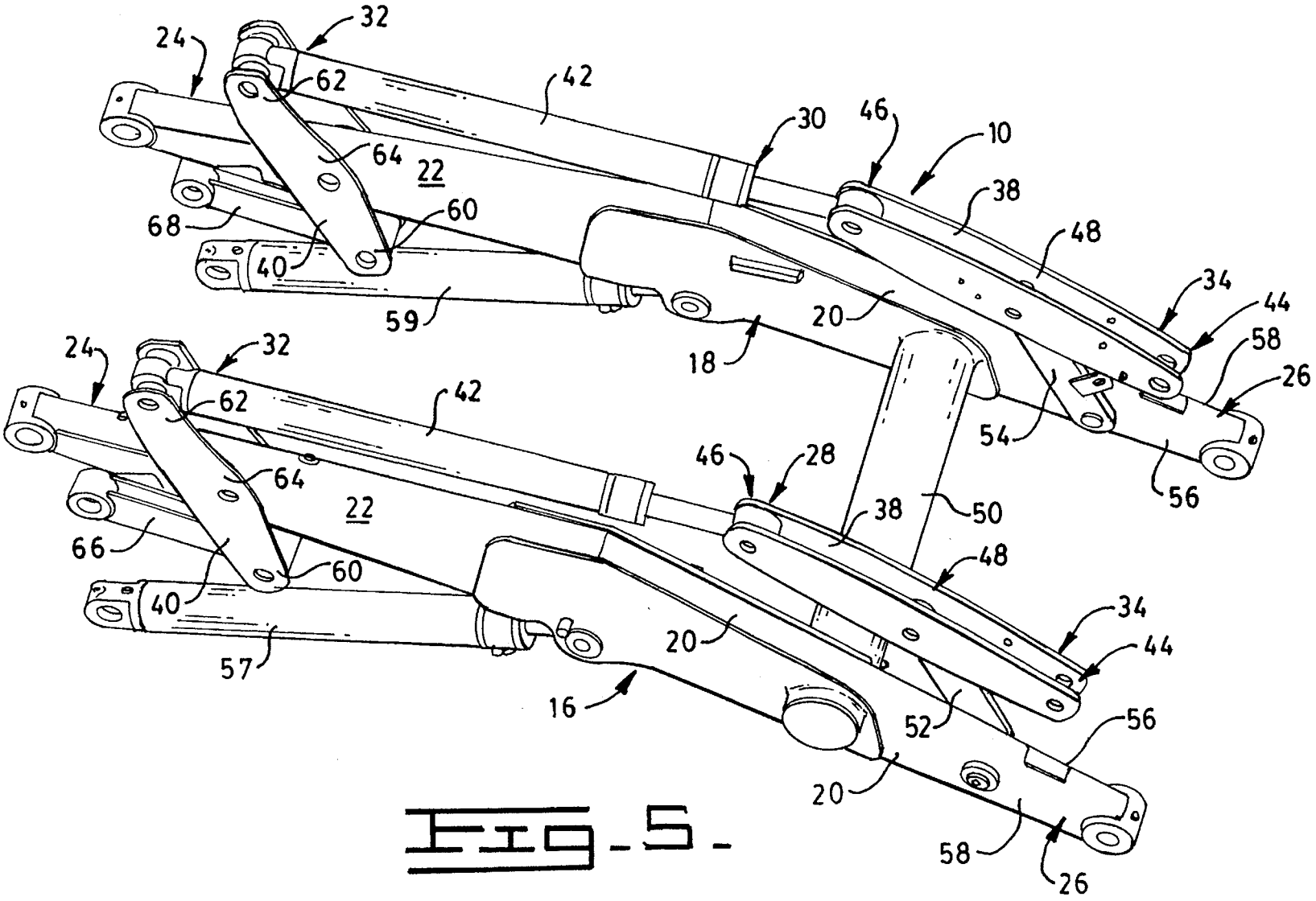
FIG. 5 is a second diagrammatic perspective view of the subject lift arms and linkage arrangement with the work implement removed.

With particular reference to FIGS. 4 and 5, the bucket 12 has first, second, third, and fourth brackets 70,72,74,76. The second end portion 26 of the first lift arm assembly 16 is adapted to be positioned between the first and second brackets 70,72 and connected thereto, and the second end portion of second lift arm assembly 18 is adapted to be positioned between the third and fourth brackets 74,76 and connected thereto. Because of the divergence of the lift arm assemblies 16,18, and the parallelism of the linkage assemblies 28,30, the first end portions 34 of the first bifurcated brackets 38 are adapted to straddle the second and third brackets 72,74 and connect thereto.

Industrial Applicability

With reference to the drawings, the subject invention is particularly useful with work machines, such as backhoe loading machines, track loading machines, and wheel loading machines. All of the above noted machines have a bucket on the forward end of the machine which is used for various functions, including loading material into trucks, digging material and transporting it to a dump site, and cleaning and hauling loose material from construction and building sites. Because the arms and linkage arrangements which connect the bucket to the machine are in front of the machine operator, it is difficult for the operator to see the outside edges or corners of the bucket. The subject invention has the lift arm assemblies 16,18 and the linkage assemblies 28,30 connected to the machine 14 at a narrow gage or distance "d". As the lift arm assemblies 16,18 extend outwardly to connect to the bucket 12, they diverge with respect to the centerline 36 of the machine 14. The lift arm assemblies 16,18 are connected to the bucket 12 at a spaced apart distance of "D", which is considerably greater than the distance "d". Although the lift arm assemblies 16,18 diverge with respect to the machine centerline 36, the linkage assemblies 28,30 remain substantially parallel to the centerline 36. To make this possible, the guide links 52,54 connect the lift arm assemblies 16,18 to the respective linkage assemblies 28,30. The guide links 52,54 are essentially aligned with the linkage assemblies 28,30, but are offset with the lift arm assemblies 16,18. This provides that the lift arm assemblies 16,18 are narrow at the machine connection, for good operator visibility, and are wide at the bucket connection, for stability of the bucket 12.

Other aspects, objects, and advantages of this invention can be obtained from a study of the drawings, the disclosure, and the appended claims.

I claim:

1. An arrangement of lift arms and linkage for lifting and manipulating a bucket of a machine, said machine having a centerline, comprising:

first and second spaced apart lift arm assemblies, each arm assembly having a first end adapted to be connected to a machine and a second end adapted to be connected to a bucket;

first and second linkage assemblies associated with respective lift arm assemblies, each linkage assembly having a first end connected to the first end of a respective lift arm assembly and a second end adapted to be connected to said bucket, said linkage assemblies being substantially parallel to said centerline; and said first and second lift arm assemblies being substantially non-parallel to said centerline.

2. An arrangement, as set forth in claim 1, wherein said first and second lift arm assemblies diverge with respect to said centerline.

3. An arrangement, as set forth in claim 1, including a first single guide link connected between said first lift arm assembly and said first linkage assembly, and a second single guide link connected between said second lift arm assembly and said second linkage assembly.

4. An arrangement, as set forth in claim 3, wherein said first and second single guide links are positioned adjacent said second ends of said lift arm assemblies.

5. An arrangement, as set forth in claim 3, wherein each linkage assembly includes a first bifurcated bracket adapted to be connected to said bucket and said first and second single guide links are connected between respective first and second lift arm assemblies and said bifurcated brackets.

6. An arrangement, as set forth in claim 5, wherein each of said lift arm assemblies includes a front beam portion having inner and outer side portions, and said first and second single guide links are connected to said respective inner side portions.

7. An arrangement, as set forth in claim 5, wherein each of said first bifurcated brackets has first and second end portions and a middle portion, said first end portion being adapted to be connected to said bucket, and said single guide links are connected to said middle portions of said bifurcated brackets.

8. An arrangement, as set forth in claim 7, including a second bifurcated bracket connected to each arm assembly and a fluid cylinder connected between said second end portion of said first bifurcated brackets and said second bifurcated bracket.

9. An arrangement, as set forth in claim 2, including a cross-beam connecting said first lift arm assembly to said second lift arm assembly.

10. An arrangement, as set forth in claim 3, including a connecting link connecting each lift arm assembly to said machine.

11. An arrangement, as set forth in claim 7, wherein said bucket has first, second, third, and fourth brackets, said second end of said first lift arm assembly being adapted to be positioned between said first and second brackets and said second end of said second lift arm assembly being adapted to be positioned between said third and fourth brackets, and said first end portions of said first bifurcated brackets being adapted to straddle said second and third brackets.

12. An arrangement of lift arms and linkage for lifting and manipulating a work implement of a work machine, said machine having a centerline, comprising:

first and second spaced apart lift arm assemblies, each arm assembly having a first end portion adapted to be connected to a work machine and a second end portion adapted to be connected to a work implement;

first and second spaced apart linkage assemblies associated with respective lift arm assemblies, each linkage assembly having a first end portion connected to the first end portion of a respective lift arm assembly and a second end portion adapted to be connected to said work implement, said linkage assemblies being substantially parallel to said centerline; and said lift arm assemblies first end portions being spaced one from the other a predetermined first distance (d) and said lift arm assemblies second end portions being spaced one from the one a predetermined second distance (D), said first distance (d) being substantially smaller than said second distance (D).

13. An arrangement, as set forth in claim 12, wherein said second distance (D) is at least 15 percent greater than said first distance (d).

14. An arrangement, as set forth in claim 12, wherein each linkage assembly includes a single guide plate connected between respective first and second linkage assemblies and first and second lift arm assemblies.

15. An arrangement of lift arms and linkage for lifting and manipulating a bucket of a machine said machine having a centerline, comprising:

first and second spaced apart lift arm assemblies, each arm assembly having a first end adapted to be connected to a machine and a second end adapted to be connected to a bucket;

first and second linkage assemblies associated with respective lift arm assemblies, each linkage assembly having a first end connected to the first end of a respective lift arm assembly and a second end adapted to be connected to said bucket, said linkage assemblies being substantially parallel to said centerline;

said first and second lift arm assemblies being substantially non-parallel to said centerline; and wherein each of said linkage assemblies includes a first bifurcated bracket adapted to be connected to said bucket, a second bifurcated bracket connected to one of said lift arm assemblies, and a fluid cylinder connected between said first and second brackets.

16. An arrangement of lift arms and linkage for lifting and manipulating a bucket of a machine said machine having a centerline, comprising:

first and second spaced apart lift arm assemblies, each arm assembly having a first end adapted to be connected to a machine and a second end adapted to be connected to a bucket;

first and second linkage assemblies associated with respective lift arm assemblies, each linkage assembly having a first end connected to the first end of a respective lift arm assembly and a second end adapted to be connected to said bucket, said linkage assemblies being substantially parallel to said centerline;

said first and second lift arm assemblies being substantially non-parallel to said centerline; and including a first single guide link connected between said first lift arm assembly and said first linkage assembly, and a second single guide link connected between said second lift arm assembly and said second linkage assembly.

17. An arrangement of lift arms and linkage for lifting and manipulating a work implement of a work machine, said machine having a centerline, comprising:

first and second spaced apart lift arm assemblies, each arm assembly having a first end portion adapted to be connected to a work machine and a second end portion adapted to be connected to a work implement;

first and second spaced apart linkage assemblies associated with respective lift arm assemblies, each linkage assembly having a first end portion connected to the first end portion of a respective lift arm assembly and a second end portion adapted to be connected to said work implement, said linkage assemblies being substantially parallel to said centerline;

said lift arm assemblies first end portions being spaced one from the other a predetermined first distance (d) and said lift arm assemblies second end portions being spaced one from the other a predetermined second distance (D), said first distance (d) being substantially smaller than said second distance (D); and wherein each linkage assembly includes a single guide plate connected between respective first and second linkage assemblies and first and second lift arm assemblies.

18. An arrangement, as set forth in claim 17, wherein said guide plate of each linkage assembly is substantially centered with the respective linkage assembly and is offset with the respective lift arm assembly.

19. An arrangement, as set forth in claim 17, including a cross-beam connecting said first arm assembly to said second arm assembly.

20. An arrangement of lift arms and linkage for lifting and manipulating a work implement of a work machine, said machine having a centerline, comprising:

first and second spaced apart lift arm assemblies, each arm assembly having a first end portion adapted to be connected to a work machine and a second end portion adapted to be connected to a work implement;

first and second spaced apart linkage assemblies associated with respective lift arm assemblies, each linkage assembly having a first end portion connected to the first end portion of a respective lift arm assembly and a second end portion adapted to be connected to said work implement, said linkage assemblies being substantially parallel to said centerline;

said lift arm assemblies first end portions being spaced one from the other a predetermined first distance (d) and said lift arm assemblies second end portions being spaced one from the other a predetermined second distance (D), said first distance (d) being substantially smaller than said second distance (D); and wherein each of said linkage assemblies includes a first bifurcated bracket adapted to be connected to said work implement, a second bifurcated bracket connected to one of said lift arm assemblies, and a fluid cylinder connected between said first and second brackets.

* * * * *